United States Patent [19]

Kaminaga

[11] Patent Number: 4,625,482

[45] Date of Patent: Dec. 2, 1986

[54] UNIT TYPE CURTAIN WALL

[75] Inventor: Hiromitsu Kaminaga, Toyama, Japan

[73] Assignee: Yoshida Kogyo K.K., Tokyo, Japan

[21] Appl. No.: 519,187

[22] Filed: Aug. 1, 1983

[30] Foreign Application Priority Data

Aug. 16, 1982 [JP] Japan ..... 57-123946[U]

[51] Int. Cl.[4] ..... E04B 1/62; E04H 1/06

[52] U.S. Cl. ..... 52/235; 52/403; 52/731; 49/DIG. 1

[58] Field of Search ..... 52/235, 772, 730, 731, 52/396, 403; 49/DIG. 1, 504

[56] References Cited

U.S. PATENT DOCUMENTS

| | | | |
|---|---|---|---|
| 3,093,217 | 6/1963 | Doede | 52/206 |
| 3,490,178 | 1/1970 | Voisin | 52/731 |
| 3,978,629 | 9/1976 | Echols, Sr. | 52/235 |
| 4,207,717 | 6/1980 | Hubbard | 52/235 |
| 4,276,729 | 7/1981 | Shiga et al. | 52/209 |
| 4,418,506 | 12/1983 | Weber et al. | 52/209 |

FOREIGN PATENT DOCUMENTS

| | | | |
|---|---|---|---|
| 2158129 | 6/1973 | Fed. Rep. of Germany | 52/235 |
| 1245748 | 9/1971 | United Kingdom | 52/235 |
| 1406537 | 9/1975 | United Kingdom . | |
| 2016566 | 9/1979 | United Kingdom | 52/235 |

*Primary Examiner*—Carl D. Friedman
*Assistant Examiner*—Michael Safavi
*Attorney, Agent, or Firm*—Hill, Van Santen, Steadman & Simpson

[57] ABSTRACT

A unit type curtain wall is disclosed, which has a plurality of connected curtain wall units each of which consists of vertical and horizontal elongated members tied together to form a rectangular unit frame and a heat insulative panel mounted to close the opening formed by the elongated members. A space is defined between the outer sides and the room sides of the frames such that it communicates with the external atmosphere, and therefore contains therein air of the same temperature as the atmospheric air. However, the air in this space is prevented from directly contacting the unit frames by sealing members and heat insulating coupling means which together form the space.

2 Claims, 4 Drawing Figures

UNIT TYPE CURTAIN WALL

BACKGROUND OF THE INVENTION

This invention relates generally to curtain walls and, more particularly, to a water-tight and heat insulating joint structure between adjacent units of a unit type curtain wall.

The joint structure between adjacent units of a unit type curtain wall is required to be effectively water-tight to prevent water from entering the room even when rain water is forcefully striking the outer surface of the curtain wall such as in a storm.

Japanese Utility Model Publication No. 57-12654 discloses a joint structure between adjacent units of a unit type curtain wall. In this structure, an air space is defined between the outer and inner sides of the curtain wall. The air space has a portion communicating with the external atmosphere, while it is sealed on the side nearer the room and on the side opposite the room except for the communicating portion. With this structure, even if water intrudes into the seal section on the side of the air space opposite the room from the outer surface of the unit type curtain wall, it will not be forced into the air space because the air pressure in the air space is the same as the atmospheric pressure. In the event of water slightly entering the air space, it no longer has sufficient momentum to clear the seal section between the air space and the room.

In the disclosed structure noted, however, the temperature of the air in the air space is the same as the atmospheric air temperature for the air space communicates with the external atmosphere. Since frames of the adjacent curtain wall units at the joint are exposed to this air in the air space, the disclosed structure does not have excellent heat insulation effect.

SUMMARY OF THE INVENTION

An object of the invention is to provide a unit type curtain wall having an inter-unit joint structure which has superior heat insulating properties as well as water-tightness.

The invention is to improve the joint structure between adjacent units of a unit type curtain wall which comprises a plurality of curtain wall units arranged in side-by-side relationship and on top of each other, each unit consisting of vertical and horizontal elongated members tied together to form a rectangular unit frame and a heat insulative panel mounted to close the opening formed by the elongated members.

In this invention, the vertical and horizontal elongated members are constituted by shaped members having recesses outwardly opening in the direction parallel with the plane of the frame. The recesses are so formed that the recesses of the adjacent frames face each other. Retainers having recesses along one side thereof, respectively, are provided on the side of the shaped members facing away from the room and clamped to this side of the shaped members with heat insulating coupling interposed therebetween. Grooves are each defined between each shaped member and the associated retainer member to receive panels therein. The recesses of the retainers are so positioned that the recesses of the retainers mounted on adjacent frames face each other. Inner seal members are mounted in the opposed recesses formed in the frames and outer seal members are mounted in the opposed recesses in the opposed retainer members. The adjacent frames are connected to each other by the inner and outer seal members. An air space communicating with the external atmosphere at the ends of the shaped members of a curtain wall unit is defined by the inner and outer seal members and heat insulating coupling means. The heat insulating coupling means forming a part of the air space are in contact with the inner seal members so that the shaped members are not exposed to the air in the air space.

BRIEF DESCRIPTION OF THE DRAWINGS

The above and other objects and features of the invention will become more apparent from the description of an embodiment thereof when the same is read with reference to the accompanying drawings, in which.

DESCRIPTION OF THE PREFERRED EMBODIMENT

Figure 1:
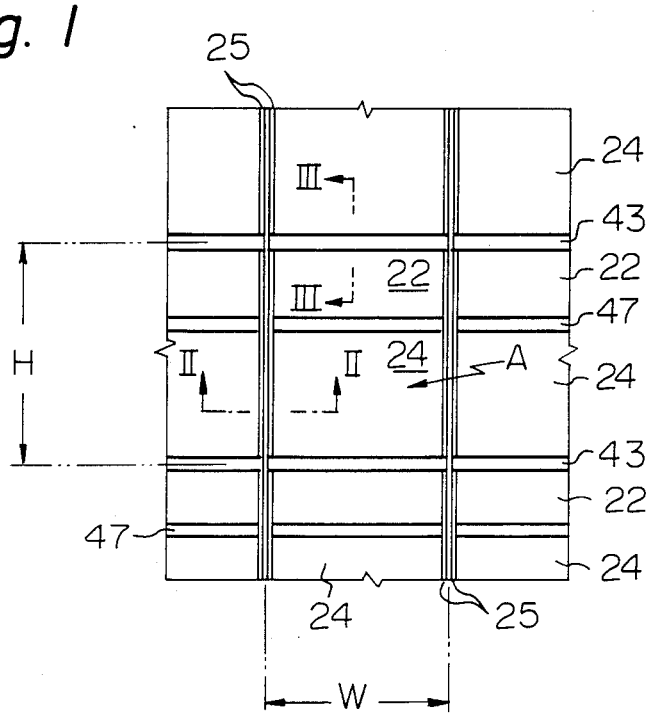
FIG. 1 is a front elevational view showing a curtain wall comprising a plurality of curtain wall units coupled together.
Figure 1A:
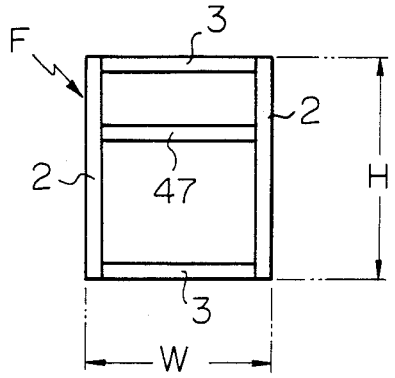
FIG. 1A is a front elevational view showing the frame of a curtain wall unit shown in FIG. 1.

Referring now to FIG. 1, there is shown a front elevational view of a curtain wall, which consists of a plurality of curtain wall units A tied together. Reference numeral 24 designates heat insulative panels and 43 throatings. Each curtain wall unit A has a height H and a width W. As shown in FIG. 1A, it has a rectangular frame F, which consists of vertical elongated members 2 and horizontal elongated members 3 tied together by suitable means. In the illustrated example, the frame F has a transom 47. The unit A is formed by attaching glass plates 22 and heat insulative panels 24 to the frame F.

Figure 2:
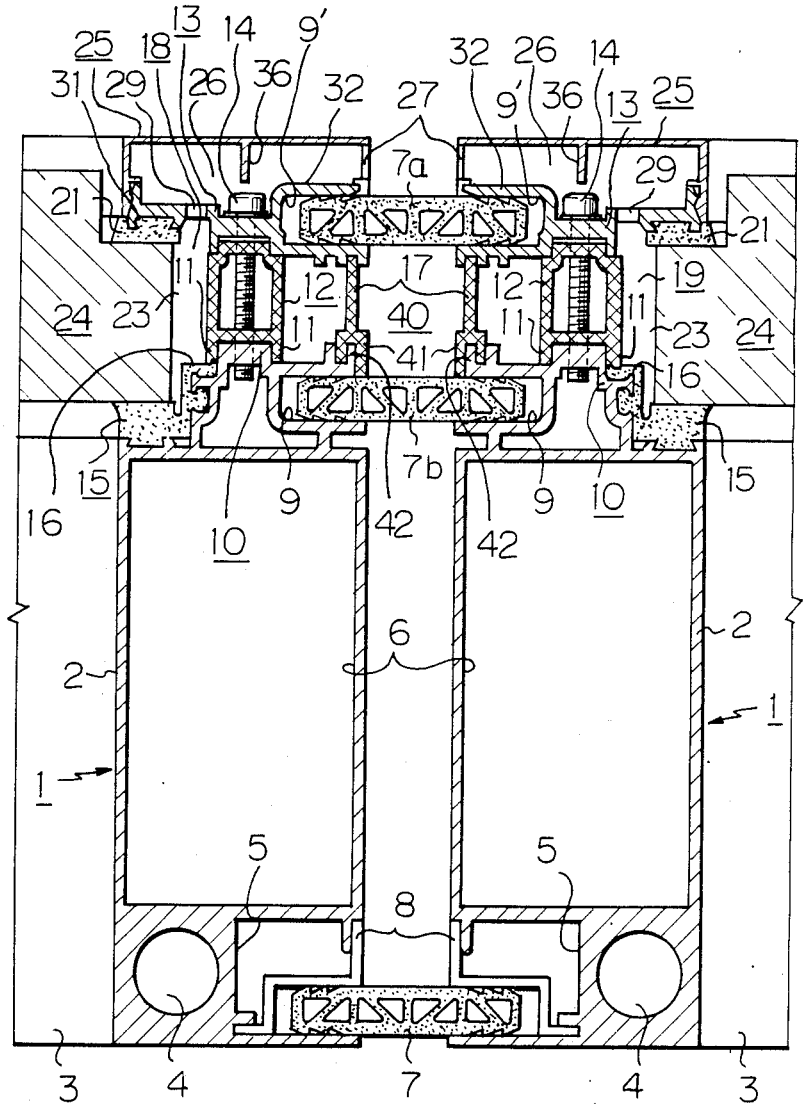
FIG. 2 is a sectional view taken along line II—II in FIG. 1.
Figure 3:
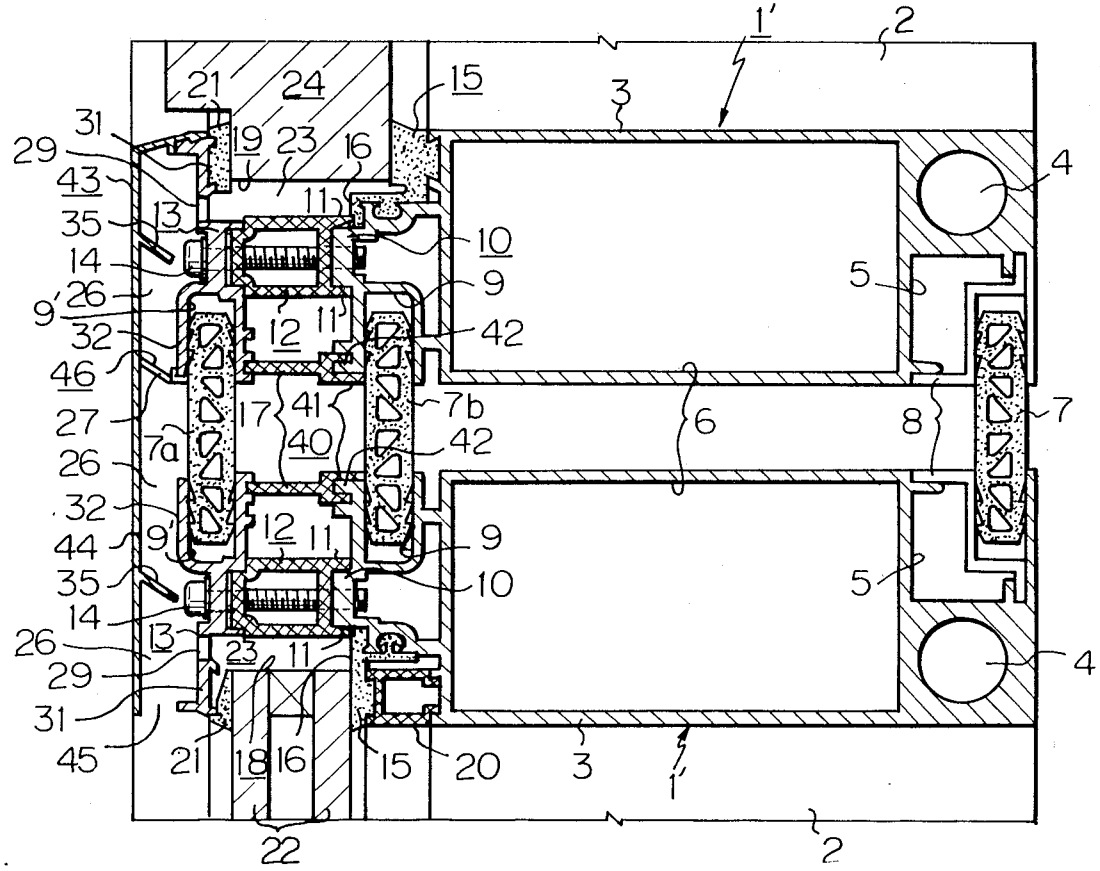
FIG. 3 is a sectional view taken along line III—III in FIG. 1.

FIGS. 2 and 3 are respectively sectional views taken along lines II—II and III—III in FIG. 1. The heat insulating structure of a curtain wall unit joint section will now be described with reference to these Figures.

Referring first to FIG. 2, there are shown opposed shaped members 1 constituting vertical elongated members 2. These shaped members 1 each have a heating medium passage 4 in the form of a cylindrical space near their face on the room side. They also each have a mounting recess 5 extending along the heating medium passage 4.

Each of the shaped members 1 further have an air passage 6 in the form of a rectangular space in their main portions.

The pair of shaped members 1 are disposed such that their mounting recesses 5 oppose each other at a predetermined distance from each other.

A heat insulating sealing member 7 is mounted via mounting members 8 in the opposed recesses 5 and extends therebetween. Therefore, the end of the space between the opposed shaped members 1 on the room side is sealed by the sealing member 7.

A heating medium such as warm or cool water may be passed through the heating medium passages 4 formed in the shaped members 1 as noted above, while allowing heat conduction to the air passing through the air passages 6 extending along the heating medium passages 4 to condition the air in the room. However, the invention is not limited to the use of these particular shaped members.

The opposed shaped members 1 each have a recess 9 formed adjacent to their face on the side opposite the room so that the recess outwardly opens in the direction parallel with the plane of the frame. The openings of these recesses 9 oppose each other. A heat insulating sealing member *7b* is mounted in the recesses 9 and extends therebetween.

The shaped members 1 each have a generally rectangular projection 10 formed adjacent to the recess 9.

Each projection 10 is hollow and defines an inner space. A generally rectangular heat insulating coupling member 12 having legs 11 is fitted on the projection 10. A pair of retainer members 13 are each fitted on each heat insulating coupling member 12 on the side thereof opposite to the room. Each of them is secured by a bolt 14 to the projection 10 of each shaped member 1 with the coupling member 12 therebetween.

A sealing member 15 is fitted on one side (inner side of the frame) of each projection 10. One of the legs 11 of the coupling member 12 is held pressed against an engaging surface portion 16 of the sealing member 15, thus providing gas-tightness and liquid-tightness at this point.

The retainer member 13 is further coupled to the associated shaped member 1 via a heat insulating coupling member 17. The heat insulating coupling member 17 prevents heat conduction between the retainer member 13 and shaped member 1.

Each of the pair of retainer members 13 has a stem portion 31 and an integral bifurcated portion 32. Recesses 9' are defined by the bifurcated portions 32 of the pair of retainer members 13 to outwardly open in the direction parallel with the plane of the frames and to oppose each other. An outer heat insulating sealing member *7a* is mounted in the opposed recesses 9' and extends therebetween. The end of the space between the opposed shaped members 1 on the side opposite to the room is sealed by the heat insulating sealing member *7a*. The inner and outer heat insulating sealing members *7b* and *7a* and the pair of heat insulating coupling members 17 define a space 40. The space 40 communicates with the external atmosphere at the end of the curtain wall unit A, i.e., at the end of the vertical and horizontal elongated members 2 and 3, and its inner pressure is thus balanced with the atmospheric pressure.

Each heat insulating coupling member 17 that couples the retainer member 13 and shaped member 1, has a cover portion 41 covering in co-operation with the heat insulating sealing member *7b* a portion 42 of the shaped member adjacent to the space 40. The cover 41 has an end in contact with the sealing member *7b* and thus serves to prevent the contact of the shaped member 1 with air in the space 40 communicating with the external atmosphere. This arrangement can completely prevent heat conduction from the space 40 to the shaped member 1 which is closer to the interior of the room.

The shaped member 1, coupling member 12 and retainer member 13 on each side of the seal define a groove 18 (or 19) open inwardly of the frame F and extending along the inner periphery thereof. A heat insulative panel 24 is fitted in the groove 18 via sealing members 15 and 21 such that it can be displaced relative to the frame F in a direction parallel to the surface thereof.

In the groove 18, a space 23 is defined by the panel 24, retainer member 13, coupling member 12 and sealing member 15 fitted on the shaped member 1.

Another panel 24 is similarly received in the other groove 19 via sealing members 15 and 21 for displacement relative to the frame F in a direction parallel to the surface thereof. A space 23 is also defined in this groove 19 for accommodating the relative displacement of the panel 24.

Reference numeral 25 designates a pair of covers. Each of them is fitted on each retainer member 13 such as to define a space 26 therewith, and has a partitioning wall portion 36 projecting from the inner surface thereof.

The pair of covers 25 have respective holes 27 formed in their opposed walls. The retainer members 13 each have a hole 29 communicating the spaces 26 and 23. The inner pressures in the spaces 26 and 23 are thus kept equal to the atmospheric pressure.

Referring now to FIG. 3, there are shown opposed shaped members 1' constituting horizontal elongated member 3. Like the shaped members 1, the shaped members 1' each have a heating medium passage 4 in the form of a cylindrical space near their face on the room side and a mounting recess 5 extending along the heating medium passage 4.

Each shaped member 1' further has an air passage 6 in the form of a rectangular space in its main portion.

The pair of shaped members 1' are disposed such that their mounting recesses 5 oppose each other in the vertical direction at a predetermined distance from each other.

A sealing member 7 is mounted via mounting members 8 in the opposed recesses 5 and extends therebetween. Therefore, the end of the space between the opposed shaped members 1' on the room side is sealed by the sealing member 7.

A heating medium such as warm or cool water may be passed through the heating medium passages 4 formed in the shaped members 1' as noted above, while allowing heat conduction to the air passing through the air passages 6 extending along the heating medium passages 4 to condition the air in the room. However, like the case of the shaped member 1, the invention is not limited to the use of these shaped members 1'.

The opposed shaped members 1' each have a recess 9 formed adjacent to their face on the side opposite to the room so that the recess outwardly opens in the direction parallel with the plane of the frame. The openings of these recesses 9 oppose each other in the vertical direction. A heat insulating sealing member *7b* is mounted in the recesses 9 and extends therebetween.

The opposed shaped members 1' each have a generally rectangular projection 10 formed adjacent to the recess 9.

Each projection 10 is hollow and defines an inner space. A generally rectangular heat insulating coupling member 12 having legs 11 is fitted on the projection 10. A pair of retainer members 13 are each fitted on heat insulating coupling member 12 on the side thereof opposite to the room. Each of them is secured by a bolt 14 to the projection 10 of each shaped member 1' with the coupling member 12 therebetween.

A sealing member 15 is fitted on one side (inner side of the frame) of each projection 10. One of the legs 11 of the coupling member 12 is held pressed against an engaging surface portion 16 of the sealing member 15, thus providing gas-tightness and liquid-tightness at that point.

The retainer member 13 is further coupled to the associated shaped member 1' via a heat insulating coupling member 17. The heat insulating coupling member 17 prevents heat conduction between the retainer member 13 and shaped member 1'.

Each of the pair of retainer members 13 has a stem portion 31 and an integral bifurcated portion 32. Recesses 9' are defined by the bifurcated portions 32 of the pair of retainer members 13 to outwardly open in the direction parallel with the plane of the frame and to oppose each other. An outer heat insulating sealing member *7a* is mounted in opposed recesses 9' and extends therebetween. the end of the space between the opposed shaped members 1 on the side opposite the room is sealed by the heat insulating sealing member *7a*. Thus, like the case of the space between the vertical elongated members 2, the inner and outer heat insulating sealing members *7b* and *7a* and the pair of heat insulating coupling members 17 define a space 40 between the horizontal elongated members 3.

The space 40 communicates with the external atmosphere at the end of the curtain wall unit A, i.e., at the end of the vertical and horizontal elongated members 2 and 3, and its inner pressure is thus balanced with the atmospheric pressure.

Each heat insulating coupling member 17 that couples the retainer member 13 and shaped member 1', has a cover portion 41 covering, in co-operation with heat insulating sealing member *7b*, a portion 42 of the shaped member adjacent to the space 40. The cover 41 has an end in contact with the sealing member *7b*, and thus serves to prevent the contact of the shaped member 1' with air in the space 40 communicating with the external atmosphere. This arrangement can completely prevent heat conduction from the space 40 to the shaped member 1' which is closer to the interior of the room.

The shaped member 1', coupling member 12 and retainer member 13 on each side of the seal define a groove 18 (or 19) open inwardly of the frame F and extending along the inner periphery thereof. A pair type glass plate 22 constituting a panel is fitted in the groove 18 via a spacer 20 and sealing members 15 and 21.

In the groove 18, a space 23 is defined by the combination of the pair type glass plate 22, retainer member 13, coupling member 12 and sealing member 15 fitted on the shaped member 1'.

A heat insulative panel 24 is similarly received in the other groove 19 via sealing members 15 and 21 for displacement relative to the frame F in a direction parallel to the surface thereof. A space 23 is also defined in the groove 19 for accommodating the displacement of the panel 24.

Reference numeral 43 designates a throating. It is fitted on the upper retainer member 13 such as to define a space 26 therebetween. The main portion of the throating 43 tends to also cover the lower retainer member 13.

The throating 43 has back board portions 35 projecting from its inner surface.

The lower end of the throating 43 defines an opening 45. A hole 29 is formed in the stem portion 31 of each retainer member 13. The throating 43 has a mounting portion 46 projecting from its inner surface and having a hole 27. The spaces 23 and 26 are thus communicated with the external atmosphere, and their inner pressures are kept equal to the atmospheric pressure.

As has been explained, each of the joint sections between opposed vertical elongated members 2 and between opposed horizontal elongated members 3 is doubly sealed, with the spaces 23 and 40 communicating with the external atmosphere and containing air under the same pressure as the atmospheric pressure being formed between the sealing members 21 and *7a* on the side thereof opposite to the room and the sealing members 15 and *7b* on the side thereof nearer the room. Water that may intrude between the sealing members 21 and *7a* and surfaces supporting these sealing members due to strong wind hardly enters the spaces 23 and 40 because there is no pressure difference between the pressure in these spaces 23 and 40 and atmospheric pressure. Further, even if water slightly enters the spaces noted, any tendency to enter the room along the sealing members 15 and *7a* on the room side is far weaker than the action of water striking the outer wall with great force. Therefore, it is impossible for water to enter the room. Since the spaces 23 and 40 are in communication with the external atmosphere, air in these spaces is at the same temperature as atmospheric air. However, it is prevented from contacting the shaped members 1 and 1' by the sealing members 15 and *7b*, heat insulating coupling members 21 and heat insulating coupling members 17. Thus, it is possible to obtain a curtain wall, which has an excellent heat insulating effect in addition to the effect of preventing entry of water.

What is claimed is:

1. A unit type curtain wall having a side defining a part of a room and comprising a plurality of mutually connected curtain wall units each of which consists of vertical and horizontal elongated members tied together to form a rectangular unit frame defining an opening encompassed by the elongated members and a heat insulative panel mounted to close the opening, further comprising:

said vertical and horizontal elongated members are constituted by shaped members each having recesses on a side facing away from said room so that the recesses open laterally of the frame and face each other, and said curtain wall comprises retainer members each respectively coupled to the associated shaped member at said side facing away from said room with heat insulating coupling members extending transversely therebetween to form a lateral groove for retaining a panel between the shaped member and the retainer member, the retainer members each having recesses which open laterally of the frame and face each other;

heat insulating inner sealing members each mounted in said recesses of the shaped members facing each other;

heat insulating outer sealing members each mounted in said recesses from in said retainer members and facing each other;

said inner and outer heat insulating seal members connecting adjacent frames and forming, in cooperation with said heat insulating coupling means, a space communicating with the external atmosphere; and said heat insulating coupling means being in contact with said heat insulating inner sealing member to prevent said shaped members from being contacted by said in said space.

2. The curtain wall according to claim 1, wherein another space communicating with the external atmosphere is formed in each of said grooves by the heat insulative panel received therein, a sealing member between said panel and the corresponding retainer member, a sealing member between said panel and the corresponding shaped member and said heat insulating coupling means.

* * * * *